US007967567B2

(12) United States Patent
Liang

(10) Patent No.: US 7,967,567 B2
(45) Date of Patent: Jun. 28, 2011

(54) MULTI-PASS COOLING FOR TURBINE AIRFOILS

(75) Inventor: George Liang, Palm City, FL (US)

(73) Assignee: Siemens Energy, Inc., Orlando, FL (US)

( * ) Notice: Subject to any disclaimer, the term of this patent is extended or adjusted under 35 U.S.C. 154(b) by 931 days.

(21) Appl. No.: 11/728,887

(22) Filed: Mar. 27, 2007

(65) Prior Publication Data

US 2009/0068023 A1 Mar. 12, 2009

(51) Int. Cl.
*F03B 3/12* (2006.01)
*F01D 5/18* (2006.01)

(52) U.S. Cl. ..... 416/97 R; 415/115

(58) Field of Classification Search ..... 415/115; 416/96 R, 97 R
See application file for complete search history.

(56) References Cited

U.S. PATENT DOCUMENTS 5,232,343 A * 8/1993 Butts ..... 416/97 R
5,645,397 A * 7/1997 Soechting et al. ..... 415/115
5,752,801 A 5/1998 Kennedy
5,967,752 A 10/1999 Lee et al.
5,971,708 A 10/1999 Lee
6,099,252 A 8/2000 Manning et al.
6,220,817 B1 4/2001 Durgin et al.
6,379,118 B2 4/2002 Lutum et al.
6,955,523 B2 10/2005 McClelland
6,994,524 B2 2/2006 Owen et al.
7,021,893 B2 * 4/2006 Mongillo, Jr. et al. ..... 415/115
7,293,962 B2 11/2007 Fried et al.
2003/0108422 A1 * 6/2003 Merry ..... 416/97 R

* cited by examiner

*Primary Examiner* — Edward Look
*Assistant Examiner* — Jesse Prager

(57) ABSTRACT

An airfoil for a turbine vane of a gas turbine engine. The airfoil includes an outer wall having pressure and suction sides, and a radially extending cooling cavity located between the pressure and suction sides. A plurality of partitions extend radially through the cooling cavity to define a plurality of interconnected cooling channels located at successive chordal locations through the cooling cavity. The cooling channels define a serpentine flow path extending in the chordal direction. Further, the cooling channels include a plurality of interconnected chambers and the chambers define a serpentine path extending in the radial direction within the serpentine path extending in the chordal direction.

19 Claims, 3 Drawing Sheets

MULTI-PASS COOLING FOR TURBINE AIRFOILS

This invention was made with U.S. Government support under Contract Number DE-FC26-05NT42644 awarded by the U.S. Department of Energy. The U.S. Government has certain rights to this invention.

FIELD OF THE INVENTION

This invention is directed generally to an airfoil for a gas turbine engine and, more particularly, to a turbine vane airfoil having serpentine cooling cavities for conducting a cooling fluid to cool the vane.

BACKGROUND OF THE INVENTION

A conventional gas turbine engine includes a compressor, a combustor and a turbine. The compressor compresses ambient air which is supplied to the combustor where the compressed air is combined with a fuel and ignites the mixture, creating combustion products defining a working gas. The working gas is supplied to the turbine where the gas passes through a plurality of paired rows of stationary vanes and rotating blades. The rotating blades are coupled to a shaft and disc assembly. As the working gas expands through the turbine, the working gas causes the blades, and therefore the shaft and disc assembly, to rotate.

Combustors often operate at high temperatures that may exceed 2,500 degrees Fahrenheit. Typical turbine combustor configurations expose turbine blade assemblies to these high temperatures. As a result, turbine vanes and blades must be made of materials capable of withstanding such high temperatures. In addition, turbine vanes and blades often contain internal cooling systems for prolonging the life of the vanes and blades and reducing the likelihood of failure as a result of excessive temperatures.

Typically, turbine vanes comprise inner and outer endwalls and an airfoil that extends between the inner and outer endwalls. The airfoil is ordinarily composed of pressure and suction sidewalls extending between a leading edge and a trailing edge. The vane cooling system receives air from the compressor of the turbine engine and passes the air through the airfoil. One example of a cooling system within a vane is disclosed in U.S. Pat. No. 6,955,523. The cooling system comprises a cooling circuit formed configured as a serpentine cooling path to effect cooling of the airfoil wall.

Known serpentine cooling systems with low cooling flow rates and a large cross-sectional ratio between the inner and outer endwalls may experience diffusion flow problems and a corresponding decreased heat transfer coefficient. For example, known turbine vane airfoil cooling designs have resolved the diffusion problem for a low mass flux serpentine flow channel by including a by-pass for allowing a portion of the cooling air to flow in between the upstream and downstream serpentine flow channels. The by-pass air facilitates maintaining the through flow channel Mach number, particularly in the large cross-sectional area portions of the vane located toward the outer endwall.

Accordingly, it is desirable to improve the heat transfer characteristics of cooling fluid flowing through turbine airfoils having large cross-sectional ratios between inner and outer ends of the airfoil. In particular, it is desirable to fully utilize the serpentine flow network within an airfoil, such as by avoiding a flow by-pass, including minimizing the adverse affects of diffusion flow by maintaining the Mach number as cooling fluid is conducted throughout the cooling circuit.

SUMMARY OF THE INVENTION

In accordance with one aspect of the invention, an airfoil for a turbine of a gas turbine engine is provided. The airfoil comprises an outer wall extending radially between opposing inner and outer ends of the airfoil, the outer wall comprising a pressure side and a suction side joined together at chordally spaced apart leading and trailing edges of the airfoil. A radially extending cooling cavity is located between the inner and outer ends of the airfoil and between the pressure side and the suction side. A plurality of partitions extend radially through the cooling cavity and extend from the pressure side to the suction side. The plurality of partitions define a plurality of cooling channels located at successive chordal locations through the cooling cavity. Passages extend between adjacent cooling channels at the inner and outer ends of the airfoil to define a serpentine flow path extending in the chordal direction. At least one of the cooling channels comprises a plurality of rib members defining a plurality of chambers located at successive radial locations though the at least one cooling channel, and further passages extend between pairs of adjacent chambers at one of the pressure side and the suction side to define a serpentine flow path extending in the radial direction.

In accordance with another aspect of the invention, an airfoil for a turbine vane of a gas turbine engine is provided. The airfoil comprises an outer wall extending radially between opposing inner and outer ends of the airfoil, the outer wall comprising a pressure side and a suction side joined together at chordally spaced apart leading and trailing edges of the airfoil. A radially extending cooling cavity is located between the inner and outer ends of the airfoil and between the pressure side and the suction side. A plurality of partitions extend radially through the cooling cavity and extend from the pressure side to the suction side. The plurality of partitions define a plurality of interconnected cooling channels located at successive chordal locations through the cooling cavity. The cooling channels define a serpentine flow path extending in the chordal direction. Further, the cooling channels comprise a plurality of interconnected chambers and the chambers define a serpentine path extending in the radial direction within the serpentine path extending in the chordal direction.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
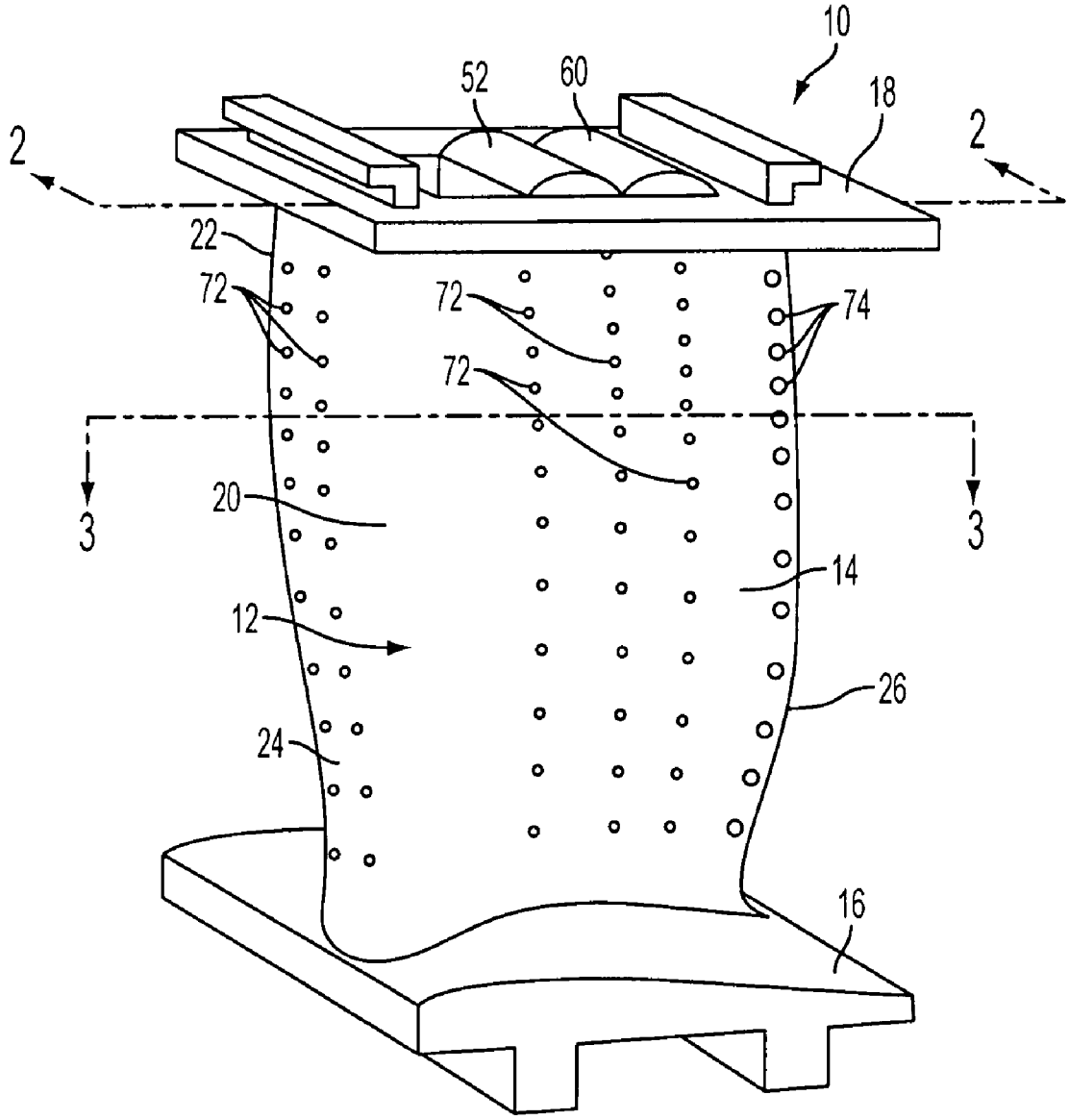
FIG. 1 is a perspective view of a turbine vane having features in accordance with the present invention.

Referring to FIG. 1, a turbine vane 10 constructed in accordance with the present invention is illustrated. The vane 10 is adapted to be used in a gas turbine (not shown) of a gas turbine engine (not shown). The gas turbine engine includes a compressor (not shown), a combustor (not shown), and a turbine (not shown). The compressor compresses ambient air. The combustor combines compressed air with a fuel and ignites the mixture creating combustion products defining a high temperature working gas. The high temperature working gas travels to the turbine. Within the turbine are a series of rows of stationary vanes and rotating blades. Each pair of rows of vanes and blades is called a stage. Typically, there are four stages in a turbine. It is contemplated that the vane 10 illustrated in FIGS. 1-4 may define the vane configuration for a second stage and/or third stage of vanes in the gas turbine The stationary vanes and rotating blades are exposed to the high temperature working gas. To cool the vanes and blades, cooling air from the compressor is provided to the vanes and the blades.

Referring to FIG. 1, the vane 10 includes an airfoil 12 comprising an outer wall 14 extending between an inner endwall 16 for locating at a radially inner location within a turbine and an outer endwall 18 for locating at a radially outer location of the turbine. The outer endwall 18 may be configured to be coupled to a vane carrier (not shown) in the turbine engine and the inner endwall 16 may be configured with seals (not shown) for sealing the vane 10 to a movable disc (not shown) within the turbine.

The outer wall 14 comprises a generally concave pressure side 20 and a generally convex suction side 22. The pressure side 20 and suction side 22 are joined together along an upstream leading edge 24 and a downstream trailing edge 26. The leading and trailing edges 24, 26 are spaced axially or chordally from each other. The airfoil 12 extends radially along a longitudinal or radial direction of the vane 10, defined by a span of the airfoil 10, from the inner endwall 16 to the outer endwall 18.

Figure 2:
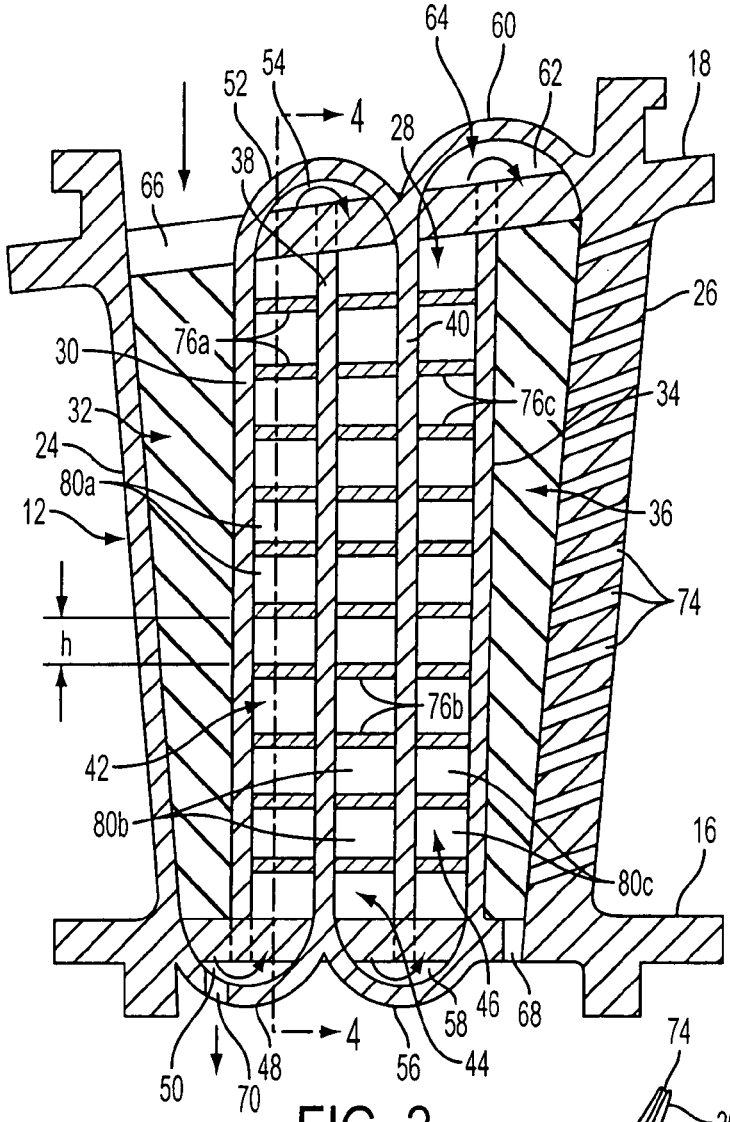
FIG. 2 is a cross-sectional view of the turbine vane shown in FIG. 1 taken along line 2-2 in FIG. 1.

Referring to FIG. 2, the airfoil 12 defines a radially extending cooling cavity 28 located between the pressure side 20 and the suction side 22 and extending between inner and outer endwalls 16, 18 of the airfoil 12. A leading edge partition 30 extends radially through the cooling cavity 28 adjacent to the leading edge 24. The leading edge partition 30 extends between the pressure and suction sides 20, 22 to define a radially extending leading edge flow channel 32. A trailing edge partition 34 extends radially through the cooling cavity 28 adjacent to the trailing edge 26. The trailing edge partition 34 extends between the pressure and suction sides 20, 22 to define a radially extending trailing edge flow channel 36. A first intermediate partition 38 and second intermediate partition 40 are located between the leading edge partition 30 and trailing edge partition 34 to define first, second and third mid-span flow channels 42, 44, 46 extending in a radial direction through the cooling cavity 28.

A radially inner end of the first intermediate partition 38 is joined to the leading edge 24 by a first inner turn connection 48 to define a first axial passage 50 interconnecting the leading edge flow channel 32 to the first mid-span flow channel 42. A radially outer end of the leading edge partition 30 is joined to a radially outer end of the second intermediate partition 40 by a first outer turn connection 52 to define a second axial passage 54 interconnecting the first mid-span flow channel 42 to the second mid-span flow channel 44. A radially inner end of the first intermediate partition 38 is joined to a radially inner end of the trailing edge partition 34 by a second inner turn connection 56 to define a third axial passage 58 interconnecting the second mid-span flow channel 44 to the third mid-span flow channel 46. A radially outer end of the second intermediate partition 40 is joined to the trailing edge 26 by a second outer turn connection 60 to define a fourth axial passage 62 interconnecting the third mid-span flow channel 46 to the trailing edge flow channel 36.

The successive flow channels 32, 42, 44, 46, 36 and respective interconnecting axial passages 50, 54, 58, 62 define an axial serpentine path 64 extending in the axial or chordal direction through the cooling cavity 28. A cooling fluid, such as air, is supplied to the leading edge flow channel 32 at an entrance 66 defined through the outer endwall 18 and passes through the axial serpentine path 64 to a radially inner end of the trailing edge flow channel 36 where the cooling fluid may exit through an exit opening 68 defined through the inner endwall 16. Cooling fluid passing through the serpentine path 64 may also exit the serpentine path 64 through an exit opening 70 formed through the first inner turn connection 48, where cooling fluid passing through the exit openings 68, 70 may be provided to cool the inner endwall 16 and to provide cooling fluid for purging the gap between the vane and adjacent moving parts, such as a rotor disc.

As seen in FIGS. 1 and 2, the airfoil may further include exhaust orifices 72 formed in the outer wall 14, including a plurality of trailing edge cooling holes 74. The exhaust orifices 72, including the trailing edge cooling holes 74, extend from the cooling cavity 28 and are positioned at locations on the outer wall 14 to provide a film of cooling fluid across the outer surface of the airfoil 10.

Referring to FIG. 2, the first mid-span flow channel 42 includes a plurality of radially spaced first ribs 76*a*, the second mid-span flow channel 44 includes a plurality of radially spaced second ribs 76*b*, and the third mid-span flow channel 46 includes a plurality of radially spaced third ribs 76*c*. Each of the ribs 76*a*, 76*b*, 76*c* extend in the circumferential direction between the pressure side 20 and the suction side 22. Further, the first ribs 76*a* extend from the leading edge partition 30 to the first intermediate partition 38 to define first chambers 80*a* within the first mid-span flow channel 42, the second ribs 76*b* extend from the first intermediate partition 38 to the second intermediate partition 40 to define second chambers 80*b*, and the third ribs 76*c* extend from the second intermediate partition 40 to the trailing edge partition 34 to define third chambers 80*c*.

Figure 3:
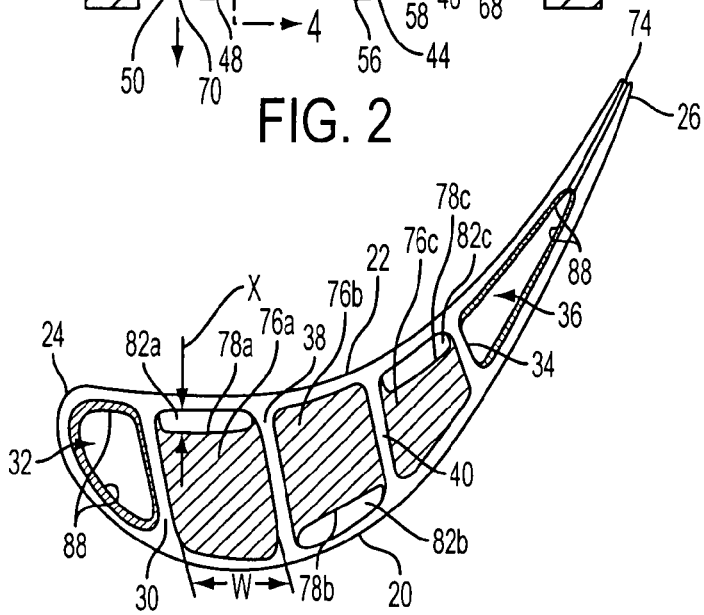
FIG. 3 is a cross-sectional view of the turbine vane shown in FIG. 1 taken along line 3-3 in FIG. 1.

Referring further to FIG. 3, each of the ribs 76*a*, 76*b*, 76*c* includes a respective distal end 78*a*, 78*b*, 78*c* that is spaced from an adjacent interior surface of one of the pressure side 20 or suction side 22 a predetermined radial passage distance, as exemplified by the distance x from the distal end 78*a* to the interior surface of suction side 22 (see also FIG. 4), to define respective radial passages 82*a*, 82*b*, 82*c*. The radial passage distance from the distal ends 78*a*, 78*b*, 78*c* to the respective pressure side 20 or suction side 22 may be selected with reference to the particular design flow rate for the airfoil 12, and may be selected to be in the range of approximately 15-25% of the length of a respective rib 76*a*, 76*b*, 76*c*. The radial passages 82*a*, 82*b*, 82*c* for each of the respective plurality of ribs 76*a*, 76*b*, 76*c* alternate between the pressure side 20 and the suction side 22, proceeding in the radial direction through each of the respective mid-span flow passages 42, 44, 46, to define radially extending serpentine paths directing cooling fluid flow in alternating circumferential directions through each of the mid-span flow passages 42, 44, 46.

Figure 4:
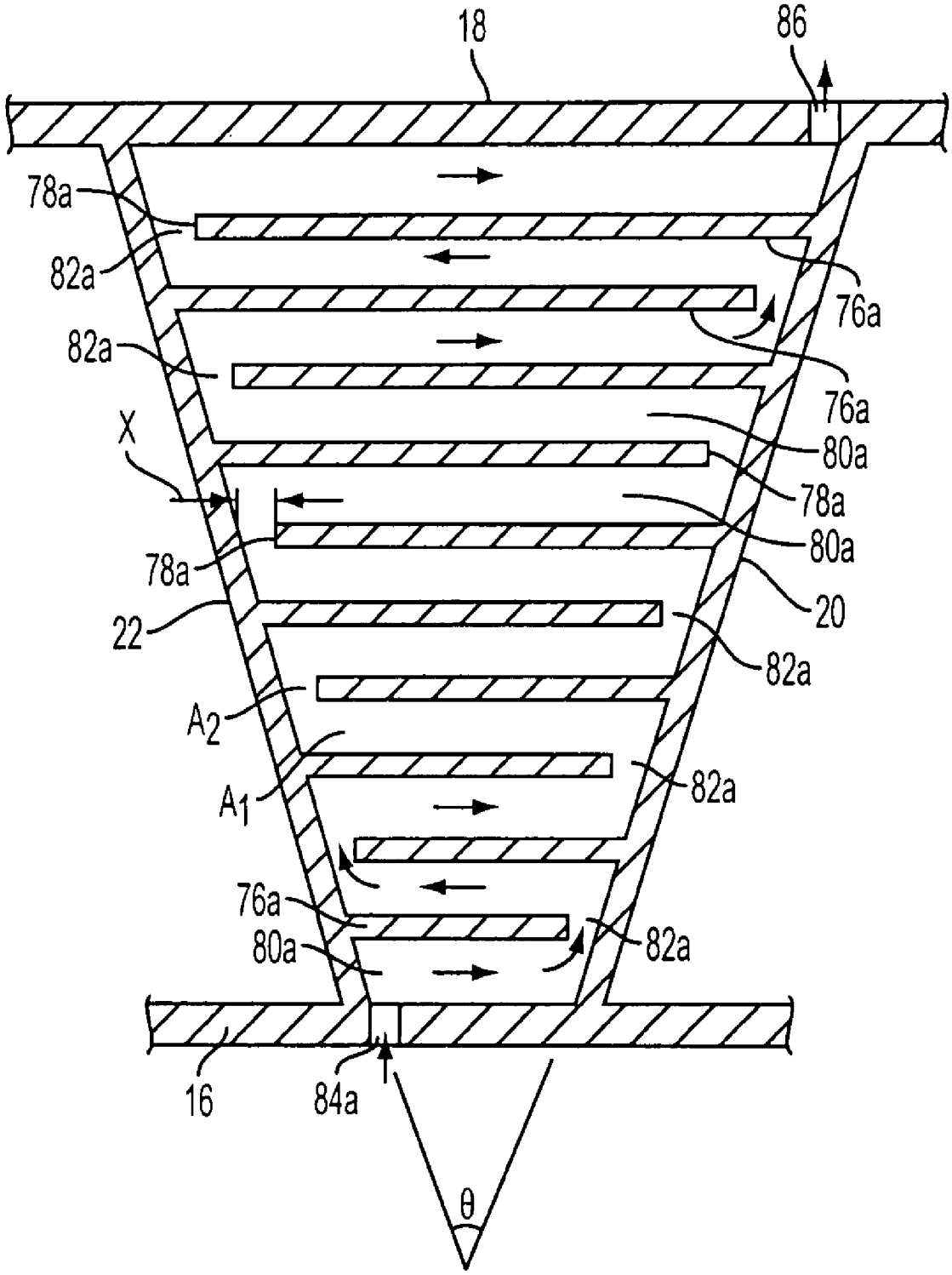
FIG. 4 is a cross-sectional view of the turbine vane shown in FIG. 1 taken at the location indicated by line 4-4 in FIG. 2.

In a particular example of the cooling fluid flow, as seen in the section view of FIG. 4 illustrating the serpentine path through the mid-span flow passage 42, the first chambers 80*a* are elongated in the circumferential direction, i.e., in the direction extending between the pressure side 20 and the suction side 22, to define elongated flow paths extending generally perpendicular to the radial direction. Cooling fluid from the first axial passage 50 enters the flow passage 42 through a fluid entrance 84*a* adjacent to the suction side 22 and flows through a first one of the chambers 80*a* in a circumferential direction toward the pressure side 20. The cooling fluid impinges on the pressure side 20, passes through a first one of the radial passages 82*a* to the next chamber 80*a*, and is directed to impinge on the suction side 22. The cooling fluid continues to flow in alternating circumferential directions to alternately impinge on the pressure side 20 and the suction side 22 until it reaches the radially outer chamber 80*a* adjacent the outer endwall 18, where it passes out of the flow passage 42 through a fluid exit 86*a* and into the second axial passage 54. The cooling fluid follows a similar serpentine path as it flows radially inwardly through the second mid-span cooling path 44 to the third axial passage 58, and as it flows radially outwardly to the fourth axial passage 62. It should be noted that fluid entrances and exits (not shown) similar to the fluid entrance 84*a* and fluid exit 86*a* of the first mid-span flow channel 42 may be provided to the second and third mid-span flow channels 44, 46, where the fluid entrances and exits may be located adjacent to either the pressure side 20 or suction side 22 to continue directing the cooling fluid flow in alternating circumferential directions as the cooling fluid transitions between the mid-span flow channels 42, 44, 46.

As seen in FIG. 4, the pressure side 20 and suction side 22 may be configured with a relatively large angle of divergence therebetween. For example, the included angle θ between the pressure side 20 and the suction side 22 may be in the range of approximately 20° to 40°, defining a large cross-sectional area ratio between the inner endwall 16 and the outer endwall 18. The ribs 76*a*, 76*b*, 76*c* defining the chambers 80*a*, 80*b*, 80*c* in the flow channels 43, 44, 46 provide control over the cross-sectional flow area to maintain a desired Mach number for efficient heat transfer. The flow area $A_1$ through the chambers 80*a*, 80*b*, 80*c* may be defined as the radial height h (see FIG. 2) between adjacent ribs 76*s*, 76*b*, 76*c* times the width distance w (see FIG. 3) between adjacent partitions 30, 38, 40, 34. In addition, the radial passages 82*a*, 82*b*, 82*c* may be formed with a flow area $A_2$ that is approximately 60% to approximately 90% of the flow area $A_1$ of the chambers 80*a*, 80*b*, 80*c*.

The particular dimensions of the chambers 80*a*, 80*b*, 80*c* and the radial passages 82*a*, 82*b*, 82*c*, i.e., the flow areas $A_1$ and $A_2$, may be selected with reference to the flow rate of the cooling fluid to optimize the cooling performance. Specifically, the dimensions for the chambers 80*a*, 80*b*, 80*c* and the radial passages 82*a*, 82*b*, 82*c* may be selected independently of the dimensions of the outer wall 14 of the airfoil 12, and preferably are selected to maintain the Mach number above a predetermined minimum value for a design cooling fluid flow rate in order to avoid or minimize the effect of diffusion on heat transfer between the cooling fluid and the interior walls of the pressure side 20 and suction side 22.

The leading edge flow channel 32 and trailing edge flow channel 36 do not include ribs, and the cooling fluid may flow in a generally straight path from the entrance 66 through the leading edge flow channel 32 to the first axial passage 50 and from the fourth axial passage 62 through the trailing edge flow channel 36 to the exit opening 68. In addition, the leading edge and trailing edge flow channels 32, 36 may be provided with trip strips 88 along the interior surfaces of the pressure and suction sides 20, 22 and at the leading edge 24 and trailing edge 26 to increase turbulence of the flow of cooling fluid along the interior surfaces, and thereby improve heat transfer at the boundary layer between the cooling fluid flow and the interior surfaces.

From the above description, it should be apparent that the presently described cooling circuit, including serpentine paths providing a circumferential fluid flow within a chordally or axially extending serpentine path, provides an effective design for cooling a turbine airfoil 12, and particularly for providing effective cooling of the pressure and suction sides 20, 22 of an airfoil 12. Further, the present design may be adjusted, such as by changing the flow cross-section of the chambers 80*a*, 80*b*, 80*c*, to accommodate particular heat load variations on the airfoil 12 and to accommodate different flow rates of cooling fluid passing through the airfoil 12.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An airfoil for a turbine of a gas turbine engine, said airfoil comprising:

an outer wall extending radially between opposing inner and outer ends of said airfoil, said outer wall comprising a pressure side and a suction side joined together at chordally spaced apart leading and trailing edges of said airfoil;

a radially extending cooling cavity located between said inner and outer ends of said airfoil and between said pressure side and said suction side;

a plurality of partitions extending radially through said cooling cavity and extending from said pressure side to said suction side, said plurality of partitions defining a plurality of cooling channels located at successive chordal locations through said cooling cavity;

axial passages extending between adjacent cooling channels at said inner and outer ends of said airfoil to define a serpentine flow path extending in the chordal direction;

at least one of said cooling channels comprising a plurality of ribs defining a plurality of chambers located at successive radial locations through said at least one cooling channel; and radial passages extending between pairs of adjacent chambers at one of said pressure side and said suction side to define a serpentine flow path extending in the radial direction, wherein said radial passages between adjacent chambers comprise a space defined by a distance between a distal end of each rib and an adjacent inner surface of one of said pressure side and said suction side, wherein said distance is about 15% to about 25% of a length of said respective rib so as to define elongated flow paths extending between adjacent ones of said ribs perpendicular to the radial direction for effecting a circumferential flow of fluid through said chambers to cause said fluid to impinge on said pressure and suction sides as the fluid flows circumferentially through said chambers.

2. The airfoil of claim 1, wherein said pressure side and said suction side converge toward each other in a direction from said outer end toward said inner end of said airfoil.

3. The airfoil of claim 2, wherein an included angle between said pressure side and said suction side is from approximately 20° to 40°.

4. The airfoil of claim 1, including a cooling fluid entrance located adjacent said outer end of said airfoil for supplying cooling fluid to said cooling cavity, and a cooling fluid exit located adjacent said inner end of said airfoil for exit of cooling fluid from said cooling cavity.

5. The airfoil of claim 4, wherein said cooling fluid entrance is located at a cooling channel adjacent said leading edge and said cooling fluid exit is located at a cooling channel adjacent said trailing edge.

6. The airfoil of claim 1, wherein a plurality of said cooling channels comprise a plurality of said ribs defining a plurality of chambers located at successive radial locations in each of said plurality of said cooling channels, and including radial passages extending between adjacent chambers at said pressure side and said suction side to define serpentine flow paths extending in the radial direction through each of said flow channels.

7. The airfoil of claim 6, including a leading edge cooling channel located adjacent said leading edge and a trailing edge cooling channel located adjacent said trailing edge wherein said leading edge and trailing edge cooling channels do not include said ribs.

8. The airfoil of claim 7, including trailing edge cooling holes extending from said trailing edge cooling channel through said trailing edge.

9. An airfoil for a turbine vane of a gas turbine engine, said airfoil comprising:

an outer wall extending radially between opposing inner and outer ends of said airfoil, said outer wall comprising a pressure side and a suction side joined together at chordally spaced apart leading and trailing edges of said airfoil;

a radially extending cooling cavity located between said inner and outer ends of said airfoil and between said pressure side and said suction side;

a plurality of partitions extending radially through said cooling cavity and extending from said pressure side to said suction side, said plurality of partitions defining a plurality of interconnected cooling channels located at successive chordal locations through said cooling cavity, said cooling channels defining a serpentine flow path extending in the chordal direction; and said cooling channels comprising a plurality of interconnected chambers defined by radially spaced ribs and corresponding radial passages extending between pairs of adjacent chambers at one of said pressure side and said suction side, and said chambers defining a serpentine path extending in the radial direction within said serpentine path extending in the chordal direction, wherein adjacent ribs within each cooling channel extend circumferentially and overlap one another in the radial direction to define elongated flow paths extending perpendicular to the radial direction such that fluid flowing along said serpentine path defined by said chambers must flow in the circumferential direction as it flows through said chambers and impinges on said pressure and suction sides as the fluid flows circumferentially through said chambers.

10. The airfoil of claim 9, wherein said serpentine flow path extending in the chordal direction directs fluid flow in alternating radial directions.

11. The airfoil of claim 10, wherein said serpentine flow path extending in the radial direction directs fluid flow in alternating circumferential directions, perpendicular to said radial direction.

12. The airfoil of claim 11, wherein said fluid flow in said alternating circumferential directions alternately impinges on inner surfaces of said pressure side and said suction side.

13. The airfoil of claim 9, wherein a flow area for fluid passing through said chambers is equal to the distance between said ribs times the distance between said partitions.

14. The airfoil of claim 13, wherein said radial passages extending between said chambers comprise a space defined by a distance between a distal end of each rib and an adjacent inner surface of one said pressure side and said suction side, wherein said distance is about 15% to about 25% of a length of said respective rib.

15. The airfoil of claim 14, wherein a flow area of said radial passages is approximately 60% to 90% of the flow area through said chambers.

16. The airfoil of claim 15, wherein said pressure side and said suction side converge toward each other in a direction from said outer end toward said inner end of said airfoil.

17. The airfoil of claim 16, wherein an included angle between said pressure side and said suction side is from approximately 20° to 40°.

18. The airfoil of claim 13, including a leading edge cooling channel located adjacent said leading edge and a trailing edge cooling channel located adjacent said trailing edge wherein said leading edge and trailing edge cooling channels do not include said ribs.

19. The airfoil of claim 18, including a cooling fluid entrance located at said outer end of said airfoil for supplying cooling fluid to said leading edge channel, and a cooling fluid exit located at said inner end of said airfoil for exit of cooling fluid from said trailing edge cavity.

* * * * *